US010816311B2

(12) United States Patent
Zemla et al.

(10) Patent No.: US 10,816,311 B2
(45) Date of Patent: Oct. 27, 2020

(54) ELECTRONIC TIME DELAY FUSE

(71) Applicant: DynaEnergetics Europe GmbH, Troisdorf (DE)

(72) Inventors: Andreas Robert Zemla, Much (DE); Sascha Thieltges, Siegburg (DE); Frank Graziola, Königswinter (DE); Eric Mulhern, Edmonton (CA); Liam McNelis, Bonn (DE); Frank Haron Preiss, Bonn (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/661,164

(22) Filed: Oct. 23, 2019

(65) Prior Publication Data

US 2020/0200516 A1 Jun. 25, 2020

Related U.S. Application Data

(60) Provisional application No. 62/756,751, filed on Nov. 7, 2018.

(51) Int. Cl.
*F42C 11/06* (2006.01)
*E21B 43/1185* (2006.01)
(Continued)

(52) U.S. Cl.
CPC ..... *F42C 11/06* (2013.01); *E21B 43/1185* (2013.01); *F42B 3/122* (2013.01);
(Continued)

(58) Field of Classification Search
CPC ..... F42C 11/06; F42C 15/34; F42C 19/06; E21B 43/1185; F42B 3/122
(Continued)

(56) References Cited

U.S. PATENT DOCUMENTS 4,572,288 A 2/1986 Kinley
4,614,156 A 9/1986 Colle, Jr. et al.
(Continued)

FOREIGN PATENT DOCUMENTS

CN 103105100 B 9/2014
CN 105403112 B 3/2017
(Continued)

OTHER PUBLICATIONS

Core Lab, 6 Minute Delay Fuse, Owen Oil Tools LP, 2010, 16 pages, Godley, Texas, https://www.corelab.com/owen/cms/docs/manuals/tcp/MAN-TC-043-000.pdf.
(Continued)

*Primary Examiner* — Samir Abdosh
(74) *Attorney, Agent, or Firm* — Moyles IP, LLC

(57) ABSTRACT

A system and a method of providing a reliable and consistent time delay in an oil and gas exploration/recovery device inserted in a bore hole is presented. The reliability and consistency of the time delay is a result of the use of electronic circuitry in determining the length of time delay. The system and method presented provide a time delay unit that is modular/commoditized, facilitating quick and easy integration of each component of the time delay unit in the field. Further, assembly and disassembly of the time delay unit is easily accomplished in the field and may be designed to operate with standard percussion and detonation elements.

20 Claims, 8 Drawing Sheets

(51) Int. Cl.

| | |
|---|---|
| ***F42B 3/12*** | (2006.01) |
| ***F42C 15/34*** | (2006.01) |
| ***F42C 19/06*** | (2006.01) |
| ***F42D 1/045*** | (2006.01) |

(52) U.S. Cl.
CPC ..... *F42C 15/34* (2013.01); *F42C 19/06* (2013.01); *F42D 1/045* (2013.01)

(58) Field of Classification Search
USPC ..... 102/215, 264, 276
See application file for complete search history.

(56) References Cited

U.S. PATENT DOCUMENTS

| | | | | |
|---|---|---|---|---|
| 4,830,120 | A * | 5/1989 | Stout | E21B 43/1185 166/298 |
| 5,173,569 | A | 12/1992 | Pallanck et al. | |
| 5,602,360 | A | 2/1997 | Sakamoto et al. | |
| 5,908,365 | A | 6/1999 | Lajaunie et al. | |
| 5,912,428 | A | 6/1999 | Patti | |
| 6,719,061 | B2 | 4/2004 | Muller et al. | |
| 7,054,131 | B1 | 5/2006 | Kanth et al. | |
| 7,721,650 | B2 | 5/2010 | Barton et al. | |
| 7,789,153 | B2 | 9/2010 | Prinz et al. | |
| 7,946,227 | B2 | 5/2011 | Koekemoer et al. | |
| 8,002,026 | B2 | 8/2011 | Arrell, Jr. et al. | |
| 8,261,663 | B2 | 9/2012 | Perez Cordova et al. | |
| 8,622,149 | B2 | 1/2014 | Gill et al. | |
| 9,273,535 | B1 | 3/2016 | George et al. | |
| 9,988,885 | B1 * | 6/2018 | Shahinpour | E21B 43/11 |
| 10,161,733 | B2 * | 12/2018 | Eitschberger | F42D 1/045 |
| 2006/0130693 | A1 | 6/2006 | Teowee | |
| 2008/0110612 | A1 | 5/2008 | Prinz et al. | |
| 2010/0051278 | A1 | 3/2010 | Mytopher et al. | |
| 2015/0007994 | A1 | 1/2015 | Lancaster et al. | |
| 2015/0376993 | A1 | 12/2015 | Vass et al. | |
| 2016/0153262 | A1 | 6/2016 | Hardesty | |
| 2018/0299239 | A1 * | 10/2018 | Eitschberger | H05K 5/0069 |
| 2019/0086189 | A1 * | 3/2019 | Eitschberger | E21B 43/1185 |
| 2020/0200516 | A1 * | 6/2020 | Zemla | F42C 11/06 |

FOREIGN PATENT DOCUMENTS

| | | | |
|---|---|---|---|
| DE | 602004004272 | T2 | 8/2007 |
| EP | 1105693 | B1 | 7/2007 |
| WO | 2012149277 | A2 | 11/2012 |

OTHER PUBLICATIONS

Schlumberger, Ballistic Timed Delay Fuse Streamlines CT Perforating with Improved Safety and Reliability, 2016 International Perforating Symposium Galveston, May 9, 2016, 9 pages, Galveston, Texas, USA.

International Searching Authority, International Search Report and Written Opinion of International App. No. PCT/EP2019/079437, which is in the same family as U.S. Appl. No. 16/661,164, dated Dec. 16, 2019, 10 pages.

* cited by examiner

ELECTRONIC TIME DELAY FUSE

CROSS-REFERENCE TO RELATED APPLICATIONS

This application claims the benefit of U.S. Provisional Application No. 62/756,751, filed Nov. 7, 2018, which is incorporated herein by reference in its entirety.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of cases after drilling, a perforating gun assembly, or train or string of multiple perforating gun assemblies, are lowered into the wellbore, and positioned adjacent one or more hydrocarbon reservoirs in underground formations. With reference to FIG. 1, a typical perforating gun assembly 40, (shown herein as a tubing conveyed perforating gun commercially available from DynaEnergetics GmbH & Co. KG), is depicted in which explosive/perforating charges 46, typically shaped, hollow or projectile charges, may be ignited to create holes in the casing and to blast through the formation so that the hydrocarbons can flow through the casing and formation.

As shown in FIG. 1, the perforating gun assembly 40 includes a gun casing or carrier or housing 48, within which various components are connected, ("connected" means screwed, abutted, snap-fit and/or otherwise assembled). At one end of the perforating gun assembly 40 of FIG. 1, a firing pin holder 41 houses a piston 42 and a percussion initiator 10. The firing pin holder 41 is connected to a top sub 45, and the top sub 45 houses a booster 43 and a detonating cord 44. The top sub 45 is connected to the gun housing 48, which houses an inner charge tube, strip or carrying device 47, which houses one or more of the charges 46. The detonating cord 44 makes a connection with each of the charge(s) 46. Between the firing pin holder 41 and a tandem sub, one or multiple time delay subs may be positioned for the purpose of creating a time gap between events in the perforating gun assembly 40, e.g., between the percussion initiator 10 being struck by the firing pin and the detonation of charges 46. This time gap may be used, for example, to pressure balance the well for optimal perforation.

Once the perforating gun(s) is properly positioned, the piston 42 is accelerated by hydraulic pressure or mechanical impact, which in turn initiates the percussion initiator 10, which initiates the booster 43 to initiate the detonating cord 44, which detonates the shaped charges 46 to penetrate/perforate the casing and thereby allow fluids to flow through the perforations.

In another assembly of the prior art as shown in FIG. 2, the firing pin holder 41 that is preferably used between perforating gun assemblies and connected using a detonating cord and booster (as shown, for instance, in FIG. 1) houses an alignment insert 4 on one end to which a firing pin housing 3 is connected. The firing pin housing 3 contains a firing pin 2 and is connected to an igniter support 6, which in turn houses an igniter or energetic material 5. In this assembly, initiation of the booster (not shown in FIG. 2) is used to accelerate the firing pin 2, which in turn initiates the igniter 5, which will either initiate the booster to initiate the detonating cord which detonates shaped charges in an adjacent, connected gun or will initiate a time delay which activates one perforating gun assembly in a string of connected guns.

As mentioned above, conventional perforating systems may provide for a pyrotechnic time delay device located within firing pin holders. The pyrotechnic time delay device interposes a time delay between the initiation of the firing pin 2 and the firing of the charges 46 carried by the perforating gun assembly 40. A time delay may be used, for example, to pressure balance the well for optimal perforation. Put simply, pyrotechnic material is selected and packaged such that ignition of the material will begin at one end and deflagration, i.e., burning, will proceed through the material at a certain velocity until it reaches the other end, where it ignites another element, e.g., a detonating cord or a bidirectional booster. The time it takes deflagration to travel from one end to the other end determines the length of time delay. Since deflagration is a chemical reaction, it is highly dependent upon the physical environment in which it is occurring. One very important environmental factor is the temperature of the time delay device, which will typically be approximately equal to the temperature of the well bore. Since a deflagration rate will vary substantially with temperature, the time delay will also vary with temperature. Generally, operators using a pyrotechnical fuse must consult a time-temperature chart before estimating the actual time delay available based on the expected temperature downhole and exposure periods.

Pyrotechnic time delay devices typically have a maximum time delay, e.g., eight minutes. When this is the case, an operator must string multiple pyrotechnic time delay devices together in series to achieve longer delays.

Due to the time and expense involved in perforating well bores and the explosive power of the devices used, it is essential that their operation be reliable and precise. Stringing together multiple pyrotechnic time delay devices diminishes the system's reliability and increases the system cost and complexity.

There is a need for methods and apparatuses to provide increased system reliability and flexibility of operation of well perforating systems. Specifically, there is a need for a time delay device used in a well perforating system to allow for adequate and precise timing of operation of a well perforating system in order to pressure balance a well or adjust the pressure conditions in the wellbore, for optimal perforation results. Such a time delay device would desirably exhibit a high level of reliability at a low level of cost and complexity of fabrication.

Advances in the art of initiating percussion initiators, particularly useful between a first perforating gun assembly and an adjacent perforating gun assembly (or multiples thereof) are constantly sought. In particular, assemblies according to the ballistic transfer module described herein improve percussion initiation, which results in improved reliability while decreasing complexity of the system, as well as lowering the cost to manufacture and assembly the perforating gun assemblies. In this regard, U.S. Pat. No. 9,988,885, which is incorporated herein by reference in its entirety, is entitled METHOD OF INITIATING A PERCUSSION INITIATOR and is directed generally to such systems and techniques.

BRIEF DESCRIPTION OF THE EXEMPLARY EMBODIMENTS

According to an aspect, the present embodiments are associated with a time delay fuse assembly which includes an electronics board having a high precision timing circuitry and a power supply for the electronics. The electronics and power supply are protected by a housing and produce a defined time-delay period between an explosive initiator and a separate electronic detonator. A first contact pin receives an impulse stimulus from the explosive initiator and connects the power supply to the electronics board. An output contact sends a digital detonation sequence to the wire-free electronic detonator.

The time delay fuse may include a first interface for connecting to a preceding gun segment or firing pin holder device, a second interface for connecting to a next gun segment or other ballistic device and a second contact pin to initiate the transmission of information to the electronic detonator. The information may include at least one of a digital addressing sequence, arming sequence and a firing sequence. Transmitting the addressing sequence, arming sequence and firing sequence signal may include transmitting a low voltage digital code to the electronic detonator. In an embodiment, the second contact pin is spring loaded.

The first contact pin may be configured to move between two plates or designed receptor profiles to establish a stable and reliable electrical connection between the two plates or profiles, thereby connecting the power supply to the electronics board. A programmed time delay period may be initiated by connecting the power supply to the electronics board. In an embodiment, the power supply includes one or more high temperature rated batteries, capable of operating at temperatures up to about 150° C.

Further embodiments of the disclosure are associated with a time delay fuse that includes an electronics board having a microcontroller and an RC oscillator to generate a high precision programmed time delay. The time delay fuse further includes a battery, and a housing to house the electronics board and the battery. The time delay fuse acts as an interface between an explosive initiator and an electronic detonator, with a first contact pin to receive an impulse stimulus from the explosive initiator and to move between two plates or receptor profiles to establish an electrical connection between the two plates or profiles, thereby connecting the battery to the electronics board. According to an aspect, the impulse stimulus includes a shock impulse or pressure wave from a detonation device. The time delay fuse includes an output contact for transmitting a digital addressing sequence, an arming sequence and a firing signal to the electronic detonator via its wireless head. The time delay fuse may include a second contact pin to initiate the transmission of the digital sequence to the electronic detonator. The addressing, arming and firing sequence may comprise a low voltage digital code to the electronic detonator. The stimulus may comprise a shock impulse or pressure wave from a detonation device.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
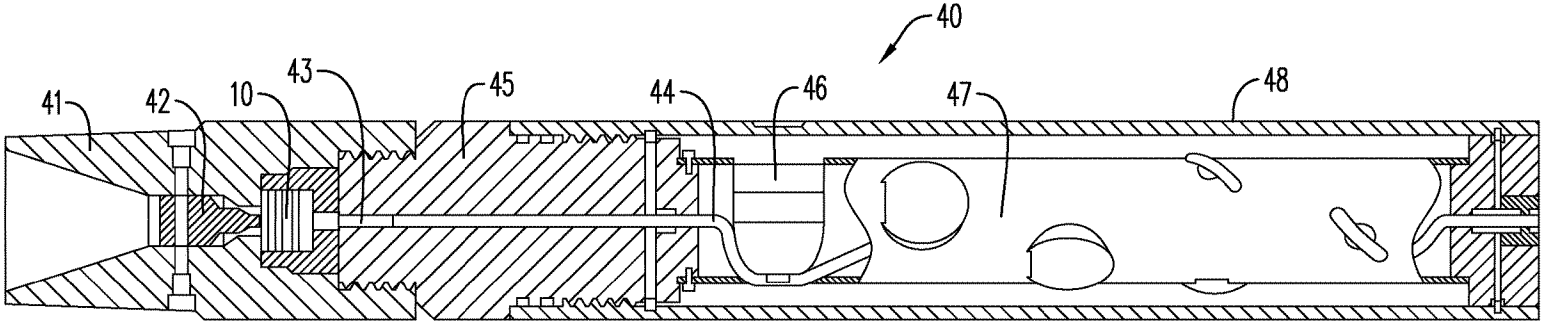
FIG. 1 (PRIOR ART)
FIG. 1 is a cross-sectional plan view of a prior art perforating gun assembly that may be utilized in combination with an electronic time delay fuse configured as described herein.
Figure 2:
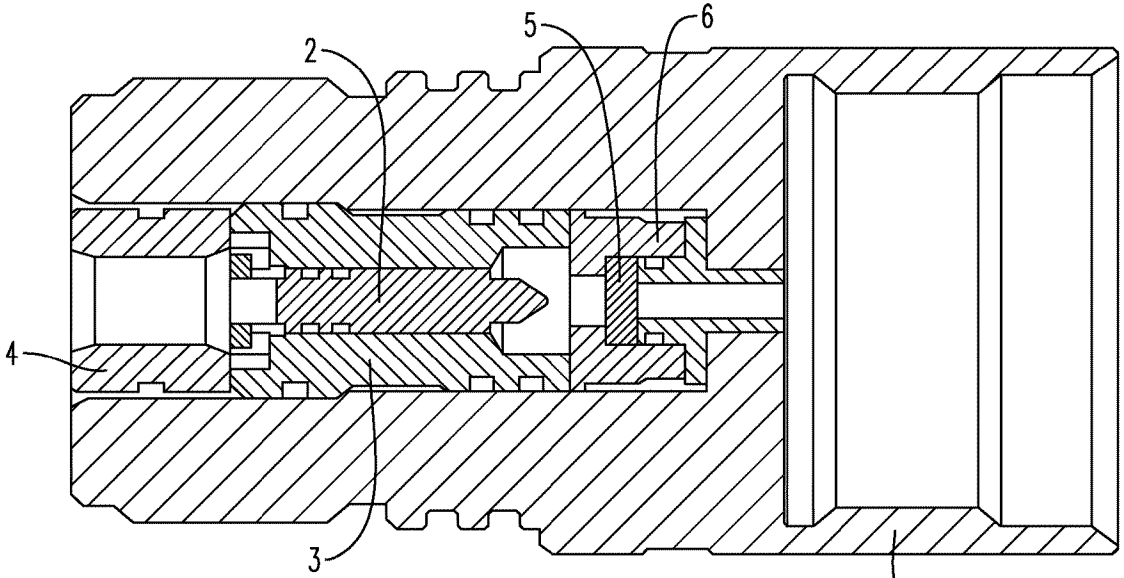
FIG. 2 (PRIOR ART)
FIG. 2 is a cross-sectional plan view of a prior art firing pin holder.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Figure 6:
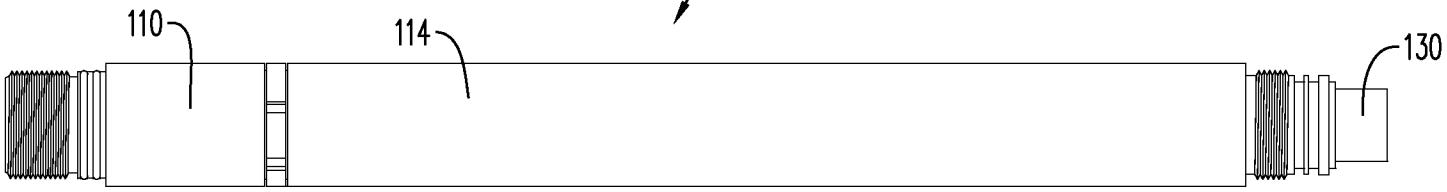
FIG. 6 is a plan view of the electronic time delay unit of FIG. 5 in an assembled condition.

FIG. 6 shows a fully assembled time delay unit 99, which includes a firing head housing assembly 110, a fuse housing 114 and a detonator housing 130. The time delay unit 99 may be packaged, shipped and/or provided to end users/operators/customers completely free of explosive components, including any detonators or initiators, for purposes of safety. If such precaution is taken, the explosive components are assembled separately by the end user (for example, an assembler or an engineer) on site. The time delay unit 99 introduces a time delay for any number of reasons, some of which have been presented above. For example, it may be desired by the operator to change the wellbore pressure conditions to an underbalanced state, in order to achieve cleaner perforation tunnels, before the perforating detonations take place. The time delay provides a defined time window for the operator to adjust his controllable conditions. Another example is that when using a coiled-tubing conveyance method, different intervals or locations in the wellbore are intended to be perforating during one run into the well. By placing the time delay units (or stacked multiple time delay units) in between perforating guns, the operator can move the entire perforating tool-string position to a different interval in the wellbore (within the predefined time delay period) before perforating that particular interval.

Figure 3:
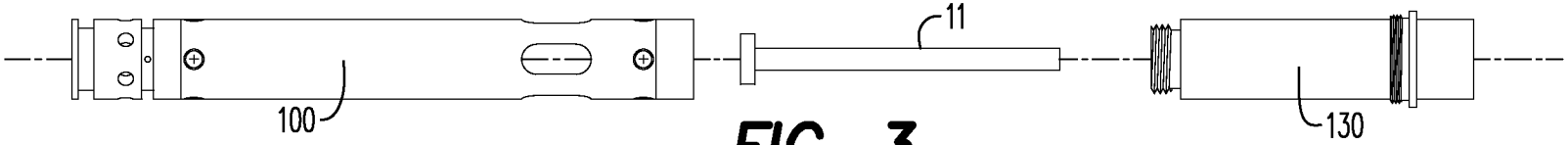
FIG. 3 is an exploded plan view of an electronic time delay fuse in an unassembled condition, in accordance with an embodiment.
Figure 4:
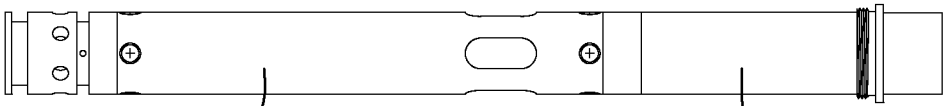
FIG. 4 is a plan view of the electronic time delay fuse of FIG. 3.
Figure 5:
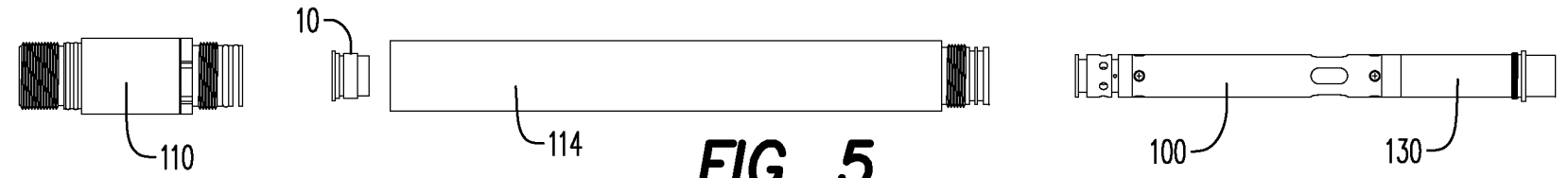
FIG. 5 is an exploded plan view of an electronic time delay unit in an unassembled condition, in accordance with an embodiment.

According to an aspect and as illustrated in FIGS. 3-6, the time delay unit 99 includes the time delay fuse 100 contained in a fuse housing 114, with the firing head housing assembly 110 attached at one end and the detonator housing 130 attached adjacent the opposite end. The firing firing head housing assembly 110 and detonator housing 130 can be made relatively easy to disconnect from the fuse housing 114 for a very useful purpose. As seen in FIGS. 3 and 5, such easy disconnection permits the percussion initiator 10 and detonator assembly 11 to be removed and shipped separately from the other components of the time delay unit 99. This facilitates ease of transport or shipping from a first location to a second location and simplifies the storage requirements. The percussion initiator 10 and the detonator assembly 11 may be inserted into their proper place immediately prior to use of the time delay unit 99. The percussion initiator 10 and detonator assembly 11 may be provided as modular elements useful in a number of detonator systems, both standard and having a time delay. Separating modular detonator assembly 11 and percussion initiator 10 results in time delay unit 99 containing no pyrotechnic/energetic elements until immediately prior to its use. This, in turn, makes it possible for the time delay unit 99 to be shipped and otherwise handled far more easily and economically.

Percussion initiator 10 may be initiated mechanically through the impact of a standard firing pin in a mechanically or hydraulic activated industry standard firing pin holder assembly. The percussion initiator 10 may also be initiated ballistically through a ballistic transfer module as described in a U.S. Pat. No. 9,890,619 filed Jul. 22, 2014, entitled BALLISTIC TRANSFER MODULE, which is incorporated herein by reference in its entirety. The method of initiating the percussion initiator 10 will usually depend on the particular application or the operation being carried out.

Figure 7:
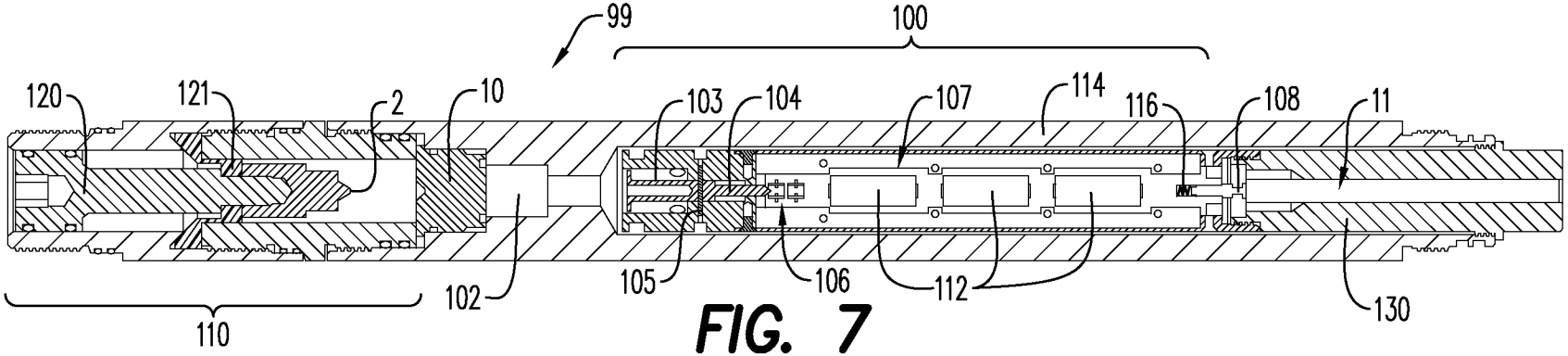
FIG. 7 is a cross-sectional plan view of a perforating gun assembly including the electronic time delay unit of FIG. 6.
Figure 8:
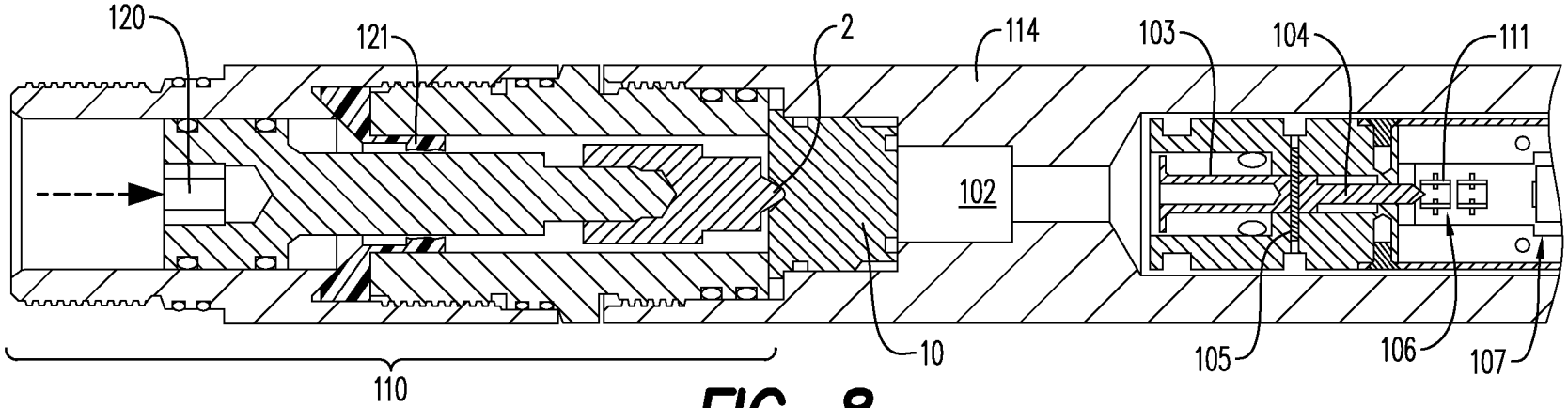
FIG. 8 is a close-up, cross-sectional plan view of the firing pin holder end of the perforating gun assembly of FIG. 7 including the electronic time delay unit of FIG. 6, illustrating a position of a firing pin prior to activation of the percussion initiator.

Firing head 120, as best seen in FIGS. 7-8, is utilized to begin a detonation sequence, as is common whether or not a time delay is desired. Firing head 120 is slideably retained in the firing head housing assembly 110. One end of the firing head 120 is exposed to a force, e.g., a pressure increase in a wellbore, and the other end is attached to a firing pin 2. The firing head 120 includes a firing pin holder tensile element 121 that prevents movement of the firing head 120 and attached firing pin 2 until the force exerted on the firing pin holder reaches a predetermined level. The firing pin holder tensile element 121 may take the form of shear pins, frangible tensile elements, a spring retaining collar or a coil spring, among other possibilities. FIG. 7 shows the firing pin holder tensile element intact and preventing movement of the firing head 120 toward the percussion initiator 10.

Once the predetermined hydraulic force level is exceeded, the holding force exerted by the firing pin holder tensile element 121 is overcome, e.g., by breaking of the shear pin or the frangible tensile element, thereby allowing the firing head 120 and attached firing pin 2 to slide rapidly within the firing head housing assembly 110. The sliding velocity of firing head 120 is sufficient to cause the firing pin 2 to strike the percussion initiator 10 with sufficient force to initiate release of explosive energy by energetic material contained within the percussion initiator 10. FIG. 8 shows the firing head 120 subsequent to the firing pin holder tensile element 121 being overcome and firing head 120 sliding axially toward percussion initiator 10. As discussed hereinabove, the time delay unit 99 may use a standard oilfield industry percussion initiator 10. Percussion initiator 10 may be inserted into the time delay unit 99 immediately prior to insertion of the time delay unit 99 into the wellbore.

Inside the time delay unit 99, no structural element exists between the percussion initiator 10 and the time delay fuse 100 portion of the time delay unit 99. That is, the time delay unit 99 has a hollow bore 102 between percussion initiator 10 and time delay fuse 100. The energy of the percussion initiator 10 is transmitted through the hollow bore 102 and exerts a force on a fuse contact pin (electronic time delay fuse contact pin) 104, either directly of by way of a plunger 103. Initially, fuse contact pin 104 is held in place by a retaining element 105 such as a shear pin. The force exerted by percussion initiator 10 overcomes the holding force of the retaining element 105, e.g., shears the shear pin 105, and permits plunger 103 to force fuse contact pin 104 into an electrically conducting contact position with an electrical connector 106 associated with a power supply 112 and/or an electronics board 107. That is, detonation of the percussion initiator 10 results in a force being exerted on plunger 103. In the event that the force on the plunger 103 is sufficient to overcome the retaining force of shear pin 105, the plunger 103 pushes fuse contact pin 104 from an initial position shown in FIG. 8 to a contact position shown in FIG. 9. The fuse contact pin 104, the plunger 103 and the retaining element 105 may be housed in a contact pin housing 132.

Figure 9:
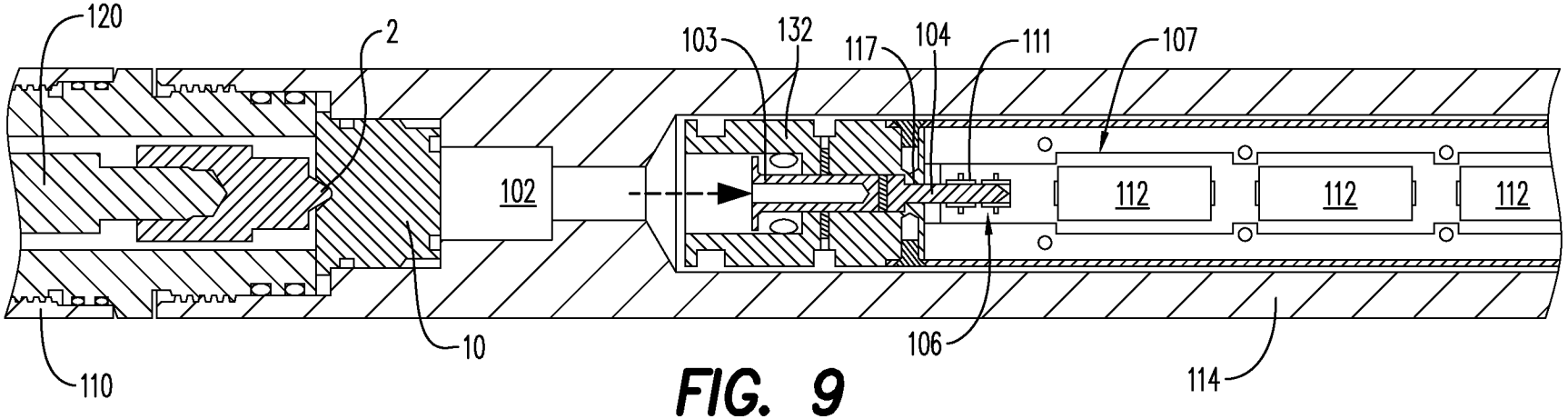
FIG. 9 is a close-up, cross-sectional plan view of the electronic time delay unit of FIG. 6 after detonation of the percussion initiator.

FIG. 7 is a cross-sectional view of the time delay unit 99 prior to sufficient hydraulic force being exerted on the firing head 120 to overcome the retaining force exerted thereon. FIG. 8 is a more detailed cross-sectional view of the firing head housing assembly 110 end of time delay unit 99 at the instant after the retaining force of the firing pin holder tensile element 121 has been overcome by a force exerted on the firing head 120 and the firing pin 2 is contacting the percussion initiator 10. FIG. 9 is a more detailed cross-sectional view of the intersection between the firing head housing assembly 110 and the time delay fuse housing 114 after the percussion initiator 10 has transmitted its energy through the hollow bore 102, overcoming the retaining element 105 holding plunger 103 in place and moving the plunger 103 and the fuse contact pin 104 into the contact position.

Figure 10B:
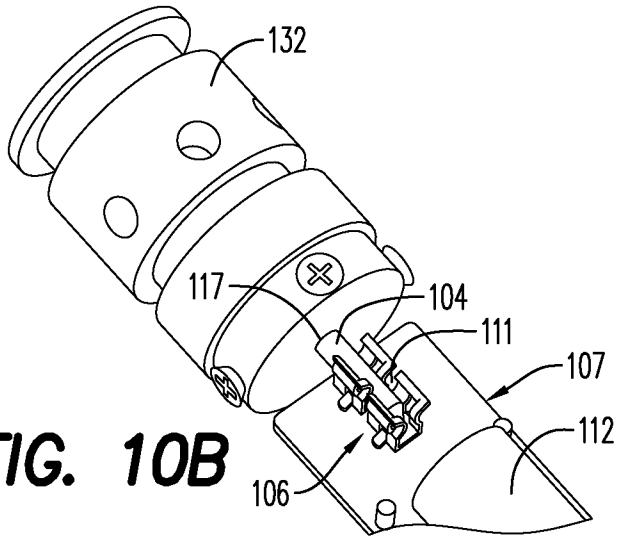
FIG. 10B is a detailed, partial cross-sectional perspective view of the electronic time delay fuse contact pin, the electronic connector and the associated structure in its connected position.
Figure 10A:
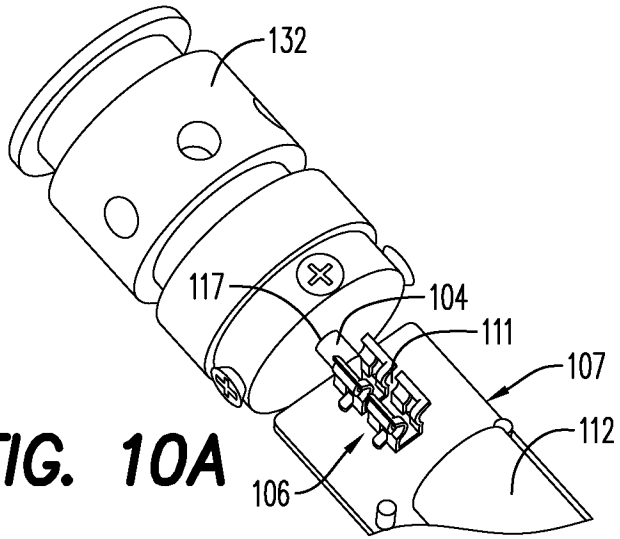
FIG. 10A is a detailed, partial cross-sectional perspective view of the electronic time delay fuse contact pin, an electronic connector and the associated structure in its initial position.

FIG. 10A is a detailed view of the contact pin housing 132, the fuse contact pin 104 and the electrical connector 106 associated with the power supply 112 and/or the electronics board 107 of the time delay fuse 100 with the fuse contact pin 104 in its initial position, i.e., in the same configuration as shown in FIGS. 7 and 8.

Figure 10C:
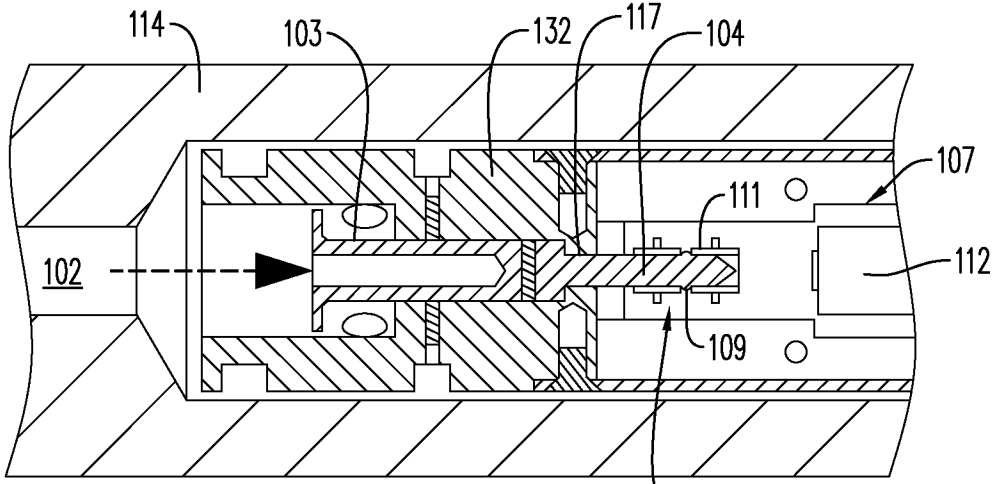
FIG. 10C is a detailed, cross-sectional plan view of the electronic time delay fuse contact pin, the electronic connector and the associated structure in its connected position showing the elements that maintain the connection.

FIGS. 10B and 10C are detailed views of the contact pin housing 132, the fuse contact pin 104 and the electrical connector 106 in the contact position, i.e., in the same configuration as shown in FIG. 9. A distal end of contact pin housing 132, i.e., the end of contact pin housing 132 closest to the electrical connector 106, has a contact pin hole 117 formed axially therein. The fuse contact pin 104 is slidingly disposed in the contact pin hole 117. In the contact position, e.g., FIG. 9, the fuse contact pin 104 has slid about as far distally as permitted by the contact pin hole 117 and an electrical connection is established between the fuse contact pin 104 and the electrical connector 106. Further, the fuse contact pin 104 is retained in place by electrical connector 106, e.g., by a frictional force exerted by electrical connector 106 on fuse contact pin 104. As best seen in FIG. 10C, a protrusion 109 may be provided on the external surface of the fuse contact pin 104. The protrusion 109 fits in a gap in tensile element 111 on the electrical connector 106, thus increasing the force with which the fuse contact pin 104 is retained in the electrical connector 106. According to an aspect, the tensile element 111 is a gap or indent in the wall of the electrical connector 106, disposed at a portion thereof or annularly over its entire radius.

Figure 13A:
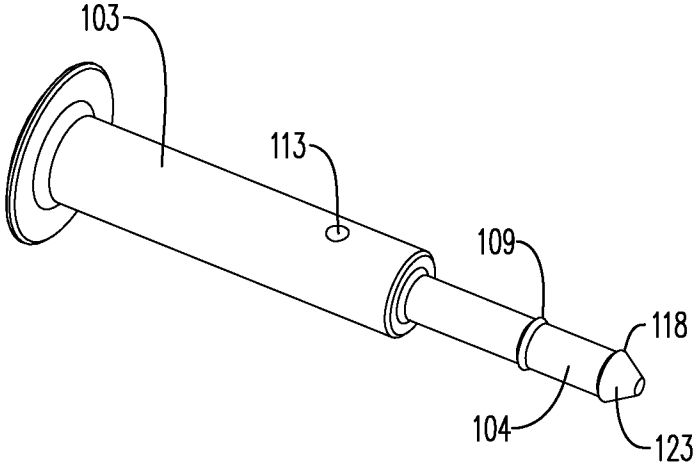
FIG. 13A is a side, perspective view of a plunger/fuse contact pin according to an embodiment.
Figure 13B:
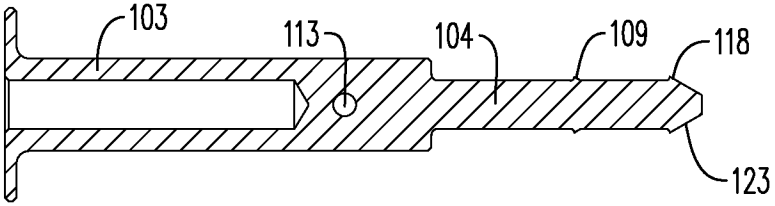
FIG. 13B is a side, cross-sectional view of the plunger/fuse contact pin of FIG. 13A.
Figure 15:
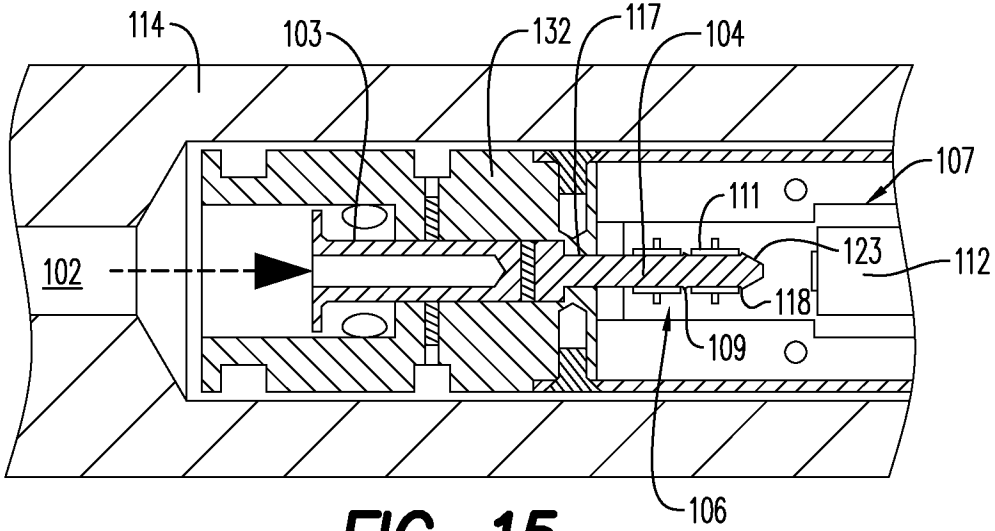
FIG. 15 is a detailed, cross-sectional plan view of the electronic time delay fuse contact pin of FIG. 13A, the electronic connector and the associated structure in its connected position showing the elements that maintain the connection.

FIG. 13A is a perspective view of an alternative plunger 103 and fuse contact pin 104 structure and FIG. 13B is a cross-sectional, side view of the plunger 103/contact pin 104 shown in FIG. 13A. The plunger 103/contact pin 104 illustrated in FIGS. 13A and 13B is similar in many ways to the same structures in FIGS. 7-10, including a hole 113 to receive retaining element (shear pin) 105 and protrusion 109 on the external surface of the fuse contact pin 104 that engages tensile element 111 when the contact pin 104 is in the contact position with the electrical connector 106. The contact pin 104 in FIGS. 13A and 13B also has a second protrusion 118 on its external surface. This second protrusion 118 is adjacent the distal tip 123 of contact pin 104 and, thus, is referred to as the distal tip protrusion 118. While protrusion 109 engages the tensile element 111 at a middle opening thereof, the distal tip protrusion 118 engages the distal end of the tensile element 111 when the contact pin 104 is fully engaged with the electrical connector 106. This engagement is illustrated in FIG. 15. The distal tip protrusion 118 adds further to the engagement strength between the contact pin 104 and tensile element 111, over and above the frictional engagement between the contact pin 104 and tensile element 111 and the engagement between protrusion 109 and tensile element 111. In an embodiment, one or both the protrusion 109 and distal tip protrusion 118 may be sized such that engagement of the contact pin 104 and tensile element 111 is effectively irreversible, i.e., without potentially damaging or destroying the electrical connector 106.

Figure 14A:
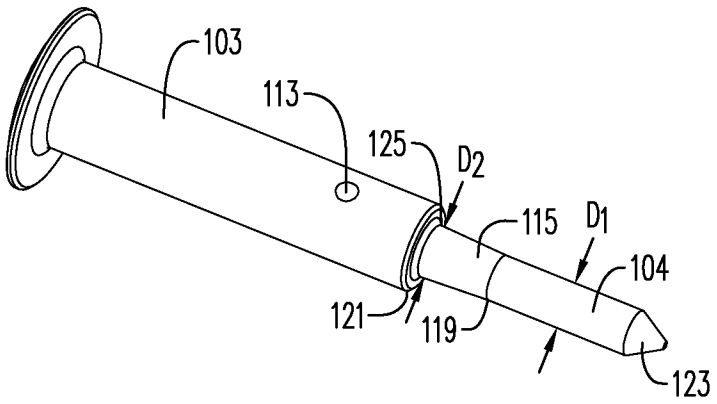
FIG. 14A is a side, perspective view of a plunger/fuse contact pin according to an embodiment.
Figure 14B:
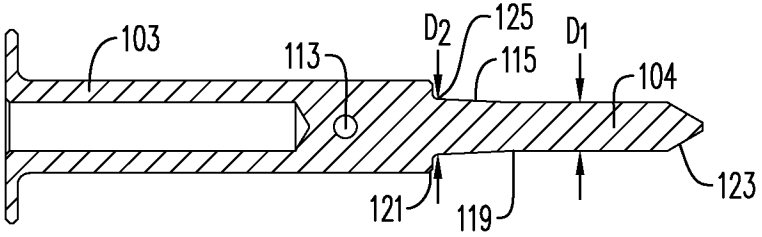
FIG. 14B is a side, cross-sectional view of the plunger/fuse contact pin of FIG. 14A.

FIG. 14A is a perspective view of another alternative plunger 103 and fuse contact pin 104 structure and FIG. 14B is a cross-sectional, side view of the plunger 103/contact pin 104 shown in FIG. 14A. The plunger 103/contact pin 104 illustrated in FIGS. 14A and 14B is similar in many ways to the same structures in FIGS. 7-10, including a hole 113 to accommodate retaining element (shear pin) 105. No protrusion 109, however, is included on the external surface of the fuse contact pin 104 in FIGS. 14A and 14B. The contact pin 104 embodiment in FIGS. 14A and 14B utilizes a different structure than protrusions 109, 118 for retaining the contact pin 104 in engagement with the electrical connector 106. From adjacent the distal tip 123 along a majority portion of the contact pin 104, the contact pin 104 has a diameter $D_1$ that is slightly smaller than the diameter of contact pin hole 117 in the distal end of contact pin housing 132, thus allowing the portion of the contact pin 104 with diameter $D_1$ to slide in contact pin hole 117. At a point 119 along the length of contact pin 104 the diameter begins a gradual increase from the diameter $D_1$ of the distal portion of the contact pin 104 to a maximum diameter $D_2$ at a proximal end 125 of the contact pin 104, where it meets the plunger 103 at a plunger shoulder 121. This gradually increasing contact pin diameter from $D_1$ to $D_2$ defines a wedge portion 115 extending from point 119 to proximal end 125 of the contact pin 104. Maximum diameter $D_2$ of the wedge portion 115 is larger than diameter of contact pin hole 117. Thus, movement of the plunger 103/contact pin 104 from starting position shown in FIGS. 7 and 8 distally, i.e., to the right according to the view in those figures, is initially permitted due to $D_1$ being slightly smaller than the diameter of contact pin hole 117. When point 119 at the beginning of wedge portion 115 enters the contact pin hole 117, the increasing diameter of the wedge portion 115 begins to frictionally engage the walls of contact pin hole 117. The force pushing plunger 103 distally and/or kinetic energy of the plunger 103/contact pin 104 assembly are sufficient to establish a substantial interference fit between the wedge portion 115 and the walls of contact pin hole 117. The combination of this interference fit and any frictional forces between the contact pin 104 and electrical connector 106, renders engagement between the contact pin 104 and electrical connector 106 effectively irreversible under expected operating conditions.

No alteration to any of the contact pin housing 132 or electrical connector 106 structures shown in FIGS. 7-10 is required to accommodate the structures of the plunger 103/contact pin 104 embodiments shown in FIGS. 13-15. That is, either or both embodiments of plunger 103/contact pin 104 shown in FIGS. 13 and 14 may be substituted for the plunger 103/contact pin 104 embodiments presented in FIGS. 7-10.

The electronics board 107 has disposed thereon one or more electrical circuits according to known techniques; these electrical circuits are referred to as "circuitry" herein. Upon retention of the fuse contact pin 104 in the electrical connector 106, an electrical connection between the electronics board 107 circuitry and the power supply 112 is established. That is, the circuitry on the electronics board 107 is provided with electric power by the power supply 112 in electrical connection therewith. Once provided with power by the power supply 112 as a result of the shifting of fuse contact pin 104, the circuitry on the electronics board 107 begins a counting sequence for a preprogrammed time delay interval. The preprogrammed time delay interval is not dependent upon the temperature of the time delay unit 99 and integral electronics board 107 or any other external/environmental circumstance. Accordingly, the exemplary embodiments are not reliant on temperature-dependent deflagration. As stated previously, variance in temperature of the wellbore and other factors that might impact the chemistry of typical pyrotechnic delay devices present substantial and difficult to assess alterations in the actual time delay in such devices.

Regarding the power supply 112, batteries would be the most readily apparent option for this. It is noted that the temperatures to which the time delay unit 99 may be exposed can be substantially higher than typical batteries are capable of withstanding in good working order. In this regard, Engineered Power of Duarte, Calif. (www.engineeredpower.com) offer battery cells with an operating temperature up to 150° C. Such cells include those designated by Engineered Power as LIR1/2AA-HT.

Figure 12A:
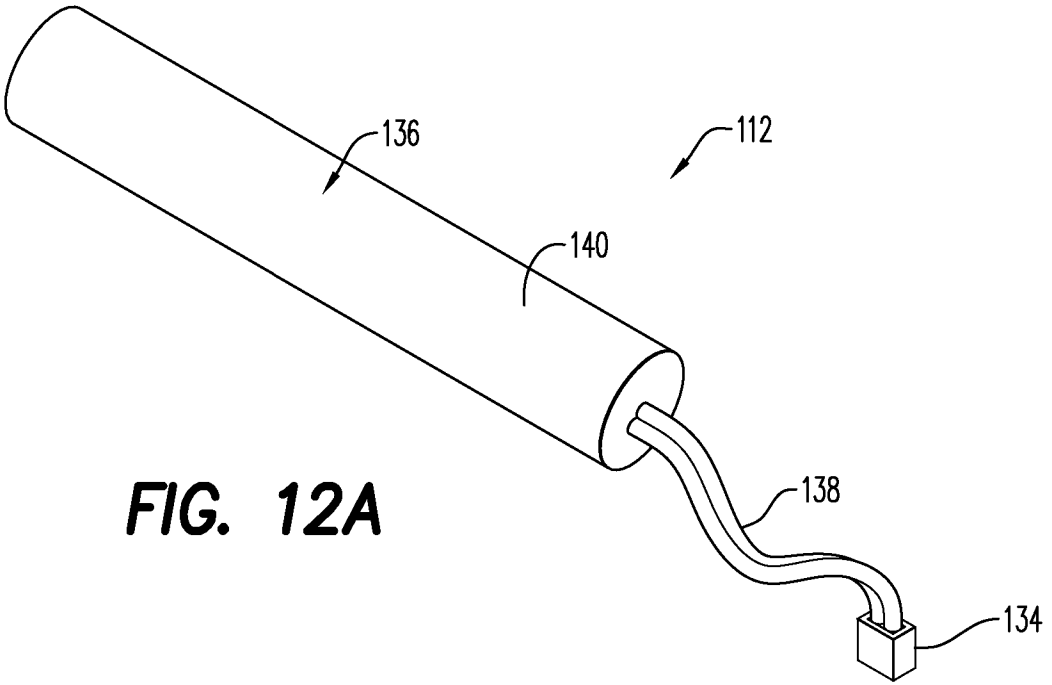
FIG. 12A is a perspective, plan view of a power supply containing multiple power cells arranged in series.
Figure 12B:
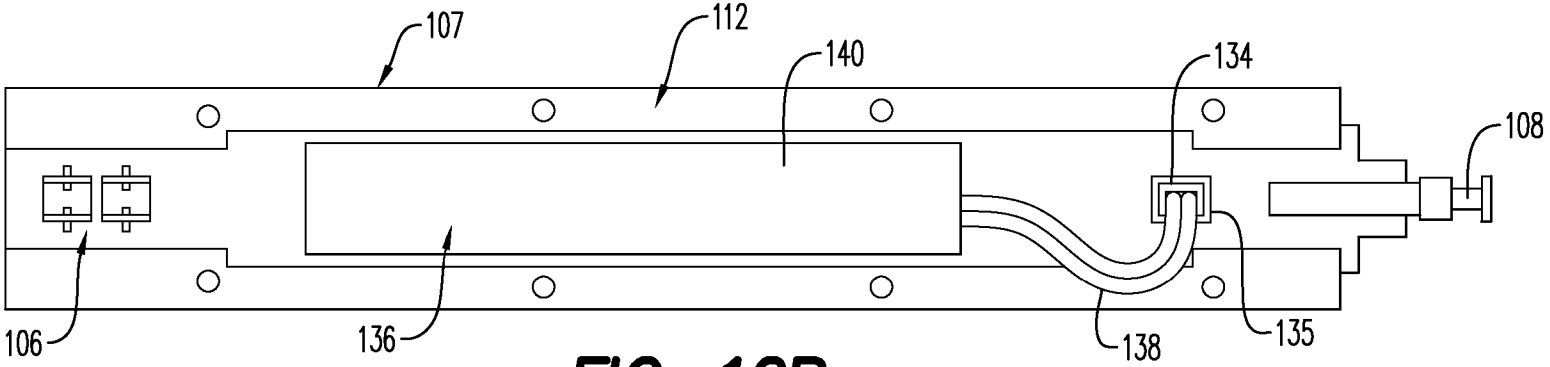
FIG. 12B is a side, plan view of the power supply of FIG. 12A mounted on and electrically attached to an electronics board.

In an embodiment illustrated in FIG. 12A, the power supply 112 may take the form of a battery pack 136 that includes multiple battery cells that are held in physical contact with one another with, for example, a plastic sleeve 140. Connecting wires 138 contact the positive and negative terminals of the battery pack 136 through the plastic sleeve and connect to a power supply connector 134. FIG. 12B shows the battery pack 136 attached to a receptacle 135 in the electronics board 107 by the connecting wires 138 and power supply connector 134. This connection permits the power supply 112 to provide power to the electronics board 107.

After the pre-programmed time delay interval has elapsed, the circuitry on the electronics board 107 sends an addressing and firing sequence through a detonator contact pin 108 to a detonator assembly 11, which will fire the detonator through its standard RF-safe electronics.

Figure 11:
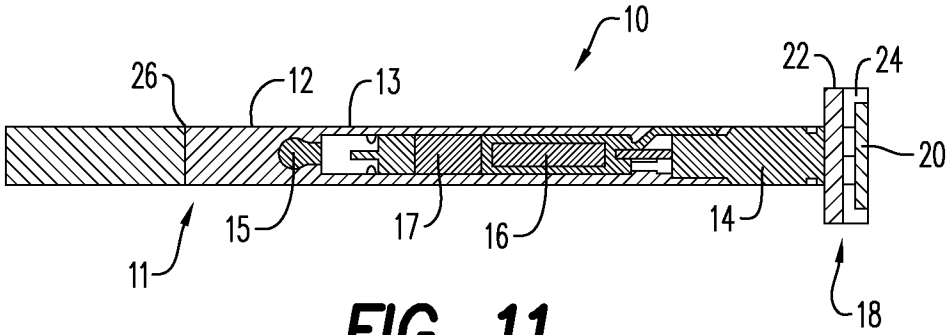
FIG. 11 is a side, cross-sectional view of a detonator assembly for use with the exemplary embodiments.

Now referring to FIGS. 7 and 11, according to an embodiment, a wirelessly-connectable selective detonator assembly 11 is provided as part of the time delay fuse unit 99 for use in perforating gun assembly 40. The detonator assembly 11 includes a detonator shell 12 and a detonator head 18 and is configured for being electrically contactably received within the time delay unit 99 without using a wired electrical connection, that is without connecting one or more wires directly to the detonator assembly 11. A detonator contact pin 108 extends from the electronics board 107 and is electrically connected to the circuitry carried on the electronics board 107. The connection between the detonator contact pin 108 and the electronics board 107 may include a spring element 116 such that the detonator contact pin 108 may be reliably contacted to a line-in portion 20 of the detonator assembly 11 without extraneous adjustments and confirmation during assembly of the time delay unit 99.

In an embodiment, the detonator shell 12 is configured as a housing or casing, typically metallic, which houses at least a detonator head plug 14, a fuse head 15, an electronic circuit board 16 and explosive components 26. The electronic circuit board 16 in the detonator shell 12 includes a capacitor 17. According to one aspect, the fuse head 15 could be any device capable of converting an electric signal into an impetus for explosive components 26 to initiate or detonate. In an embodiment shown in FIG. 11, the detonator shell 12 is shaped as a hollow cylinder. The capacitor 17 element of electronic circuit board 16 may be triggered, at an appropriate time, to initiate the fuse head 15, thereby selectively detonating the detonator assembly 11.

In an embodiment, the electronic circuit board 16 of the detonator assembly 11 is configured to receive an initiation signal from the electronics board 107 through the contactable connection between the detonator contact pin 108 and the line-in portion 20. The initiation signal may be a digital code uniquely configured for a specific detonator. By "selective" what is meant is that the detonator assembly 11 is configured to receive one or more specific digital sequence(s) from the electronics board 107, which differs from a digital sequence that might be used to arm and/or detonate another detonator assembly in a different, adjacent perforating gun assembly or tool, for instance, in the context of a train of perforating gun assemblies or other tools. So, detonation of the various tools does not necessarily have to occur in a specified sequence. Any specific tool can be selectively detonated. In an embodiment, the detonation occurs in a down-up or bottom-up sequence.

The detonator head 18 extends from one end of the detonator housing 12 and includes more than one electrical contacting component including the electrically contactable line-in portion 20 and an electrically contactable line-out portion 22. The detonator assembly 11 may also include an electrically contactable ground portion 13. The detonator head 18 may be disk-shaped. In another embodiment, at least a portion of the detonator shell 12 is configured as the ground portion 13. The line-in portion 20, the line-out portion 22 and the ground portion 13 are configured to complete the electrical connection merely by contact with other electrical contacting components, e.g., the detonator contact pin 108, a through-wire or relay (not shown) for relaying the digital signal to a subsequent perforating gun, and/or a ground contact (not shown).

The detonator head 18 also includes an insulator 24, which is positioned between the line-in portion 20 and the line-out portion 22. The insulator 24 functions to electrically isolate the line-in portion 20 from the line-out portion 22. Insulation may also be positioned between other lines of the detonator head 18. In an embodiment, the capacitor 17 may be positioned or otherwise assembled as part of the electronic circuit board 16. The capacitor 17 is configured to be discharged to initiate the fuse head 15 and subsequently the detonator assembly 11 upon receipt of the initiation signal by the detonator circuit board 16 from the electronics board 107, the initiation signal being electrically relayed directly through the line-in portion 20 and the line-out portion 22 of the detonator head 18. Once it is confirmed that the first digital code is the correct code for that specific detonator assembly, the capacitor 17 is charged.

In an embodiment, as a safety feature, a second digital code may be transmitted to and received by the detonator circuit board 16. The second digital code, which is also confirmed as the proper code for the particular detonator, closes a second gate, which in turn discharges the capacitor 17 to initiate detonation via the fuse head 15. The ballistic output from the detonator shell 12 will then initiate a perforating gun assembly or alternatively another downhole tool in the toolstring which may require a certain time delay period depending on the particular application.

The above described configuration of the time delay unit 99 allows for an electronic time delay fuse in which the initiators, boosters and all other energetic material is segregated within the time delay unit 99. As such, an incomplete time delay unit 99 less all energetic material may be shipped and handled in an extremely safe manner prior to the easy and quick integration of all required energetic materials, e.g., percussion initiator 10 and detonator assembly 11, within the complete time delay unit 99 immediately prior to its use. It is a possibility that the energetic, i.e., ballistic, components are standard oilfield components which the person assembling would typically have on-hand or in their magazine. This makes transport packaging, handling and storage conditions far less complicated. For example, the incomplete time delay unit 99 does not have to be stored within a designated explosive storage magazine.

Circuit board 107 presents a number of opportunities for including useful functionality in the time delay unit 99. The opportunity exists to include two or more microcontrollers mounted on the circuit board. Additional, independent delay time counters are also possible along with plural microcontrollers, as are multiple independent temperature sensors.

One or more immersion sensors may also be included on the electronics board 107, allowing for aborting of initiation sequence in case a fluid were to leak inside the housing. Similarly, several built-in function tests can be performed with or without the separately connected detonator. LEDs or other user interfaces may be used to indicate built-in function test results to a user during testing at the surface. Delay time may be pre-programmed by factory settings during manufacturing or by the user. A battery control circuit to de-passivate the passivation layer of lithium batteries may also be included.

It should be noted that although electrical connection of the fuse contact pin 104 and electrical connector 106 may be the absolute determiner of power to electronics board 107, it need not be. That is, after a correct sequence start of the electronics board 107 with the power supply 112 connection, the electronic time delay unit 99 may establish a self-appointed battery connection, independent of the mechanical connection to the fuse contact pin 104 and electrical connector 106. In such a situation, connection of the fuse contact pin 104 and electrical connector 106 may accomplish a different function than actually powering the electronics board 107. Loss of connection integrity by vibration or shock impact to the contact pin will not affect the function of the counting sequence.

A safety and digital control logic circuit consisting of logic gates that compare the input signals and results from the time delay counters and the signals from the temperature sensors may also be provided on the electronics board 107. The safety and control unit allows a voltage signal to be transmitted to the detonator and/or enables the transmission of the coded signal sequences to the detonator, only at one or more of the following status checks: (a) Both delay counters are equal and have accomplished the desired delay time; (b) both temperature sensors measure the same temperature above a safe minimum, e.g., 70° C.; (c) there is not fluid inside the electronic time delay unit 99; and (d) the coded signal to the detonator is generated and sent by a minimum number of micro-controllers.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include similar structural elements with insubstantial differences from the literal language of the claims.

What is claimed is:

1. A time delay fuse assembly comprising:

a housing containing an initiator, an electronics board including a circuitry and a power supply, the initiator configured to release explosive energy;

a first contact pin having a non-conducting position wherein the circuitry is not electrically connected to the power supply and an electrically conducting position wherein the circuitry is electrically connected to the power supply, the first contact pin being configured to shift from the non-conducting position to the electrically conducting position in response to the release of explosive energy by the initiator; and a detonator contact pin configured to convey a signal from the circuitry to a detonator, the circuitry being configured to produce a time-delay period that begins to run when the first contact pin shifted to the electrically conducting position and to send the signal to the detonator upon completion of the time-delay period.

2. The time delay fuse assembly of claim 1, wherein the signal comprises at least one of a digital code uniquely configured for a specific detonator, an initiation signal, an arming signal and a detonation signal.

3. The time delay fuse assembly of claim 1, wherein the detonator contact pin is spring loaded and electrically contacts a line-in portion of the detonator.

4. The time delay fuse assembly of claim 1, further comprising:

an electrical connector attached to the electronics board, the electrical connector configured to receive the first contact pin in the electrically conducting position and to electrically connect the power supply and the circuitry.

5. The time delay fuse assembly of claim 4, wherein the first contact pin includes one or more protrusions configured to engage a tensile element of the electrical connector in the electrically conducting position of the first contact pin.

6. The time delay fuse assembly of claim 4, wherein the first contact pin includes a wedge portion configured to frictionally engage a contact pin housing hole when the contact pin is in the electrically conducting position to retain the first contact pin in the electrically conducting position.

7. The time delay fuse assembly of claim 1, wherein the power supply comprises one or more high temperature rated battery cells, capable of operating at temperatures up to 150° C.

8. The time delay fuse assembly of claim 1, wherein the power supply comprises a plurality of battery cells arranged in a battery pack connected to the electronics board.

9. The time delay fuse assembly of claim 8, wherein the battery cells are held together by a plastic sleeve.

10. The time delay fuse assembly of claim 1, wherein the detonator having contactable wireless connections for being connected to the time-delay fuse at the jobsite and without manually wiring the detonator.

11. A time delay fuse comprising:

an electronics board including a circuitry configured to generate a time delay;

a power supply attached to the electronics board;

a first contact pin configured to shift from a non-conducting position to a conducting position upon receipt of a force generated by an initiator, the conducting position of the first contact pin establishes an electrical connection between the circuitry and the power supply, no electrical connection exists between the circuitry and the power supply when the first contact pin is in the non-conducting position; and a detonator in electrical contact with the circuitry;

wherein the time delay is initiated when the circuitry is electrically connected to the power supply and expiration of the time delay results in an electrical signal being sent from the circuitry to the detonator.

12. The time delay fuse of claim 11, further wherein the detonator comprising:

a detonator head attached to a detonator shell; and a detonator circuit board and a fuse head contained in the detonator shell, the fuse head connected to the detonator circuit board and configured to convert an electrical impulse from the detonator circuit board into an impetus to initiate an explosive component;

wherein the detonator circuit board is RF-safe and the electrical impulse from the detonator circuit board cannot be sent to the fuse head until after the detonator receives the electrical signal from the time delay fuse electronics board.

13. The time delay fuse of claim 12, further wherein the detonator head includes a line-in portion configured to electrically connect to the time delay fuse and a line-out portion for connecting to a separate downhole tool in a toolstring.

14. The time delay fuse of claim 11, wherein the signal comprises at least one of a digital code uniquely configured for a specific detonator, an initiation signal, an arming signal and a detonation signal.

15. The time delay fuse of claim 11, further comprising a detonator contact pin attached to the electronics board and in electrical contact with electronics board circuitry and a line-in portion of the detonator.

16. The time delay fuse of claim 11, further comprising:

an electrical connector attached to the electronics board, the electrical connector configured to receive the first contact pin in the electrically conducting position, to retain the first contact pin in the electrically conducting position and, in cooperation with the first contact pin, to electrically connect the power supply to the circuitry.

17. The time delay fuse of claim 16, wherein the first contact pin and electrical connector include means for retaining the first contact pin in the electrically conducting position with the electrical connector.

18. The time delay fuse of claim 11, wherein the power supply comprises one or more high temperature rated battery cells, capable of operating at temperatures up to 150° C.

19. The time delay fuse of claim 11, wherein the power supply comprises a plurality of battery cells arranged in a battery pack connected to the electronics board.

20. The time delay fuse of claim 19, wherein the battery cells are held together by a plastic sleeve.

* * * * *